US009081365B2

(12) United States Patent
Behrend et al.

(10) Patent No.: US 9,081,365 B2
(45) Date of Patent: Jul. 14, 2015

(54) REGULATING SYSTEM FOR A HOROLOGY MOVEMENT

(71) Applicant: Rolex SA, Geneva (CH)

(72) Inventors: Raoul Behrend, Nyon (CH); Fabiano Colpo, Lausanne (CH); Olivier Hunziker, Vevey (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/542,069

(22) Filed: Nov. 14, 2014

(65) Prior Publication Data

US 2015/0138933 A1 May 21, 2015

(30) Foreign Application Priority Data

Nov. 15, 2013 (EP) ..... 13193167

(51) Int. Cl.

| | |
|---|---|
| ***G04B 17/04*** | (2006.01) |
| ***G04B 17/06*** | (2006.01) |
| ***G04B 15/06*** | (2006.01) |
| ***G04B 18/02*** | (2006.01) |

(52) U.S. Cl.

CPC ..... *G04B 17/04* (2013.01); *G04B 15/06* (2013.01); *G04B 17/06* (2013.01); *G04B 18/02* (2013.01)

(58) Field of Classification Search

CPC ..... G04B 15/06; G04B 17/04; G04B 17/06; G04B 17/066; G04B 18/02; G04B 18/025; G04B 18/028; G04B 18/04

USPC ..... 368/124, 127, 129, 169, 175

See application file for complete search history.

(56) References Cited

U.S. PATENT DOCUMENTS

| | | | | |
|---|---|---|---|---|
| 38,393 | A * | 5/1863 | James | 368/175 |
| 2,789,414 | A * | 4/1957 | Andrews | 368/176 |
| 2,803,941 | A * | 8/1957 | Stillwell | 368/176 |
| 2,896,399 | A * | 7/1959 | Giroud | 368/176 |
| 3,154,912 | A | 11/1964 | Pinkas | |
| 8,439,555 | B2 | 5/2013 | Brossard et al. | |
| 2010/0002548 | A1 * | 1/2010 | Hessler et al. | 368/129 |
| 2010/0278017 | A1 | 11/2010 | Brossard et al. | |
| 2011/0096636 | A1 * | 4/2011 | Pellet | 368/127 |
| 2011/0222377 | A1 * | 9/2011 | Ching et al. | 368/175 |
| 2014/0029390 | A1 * | 1/2014 | Stranczl et al. | 368/176 |

FOREIGN PATENT DOCUMENTS

| | | | |
|---|---|---|---|
| CH | 850 | A | 12/1889 |
| CH | 344372 | A | 1/1960 |

(Continued)

OTHER PUBLICATIONS

European Search Report dated Jun. 12, 2014 issued in corresponding application No. EP13193167, and Written Opinion; with partial English translation and machine-translation.

*Primary Examiner* — Vit W Miska

(74) *Attorney, Agent, or Firm* — Westerman, Hattori, Daniels & Adrian, LLP

(57) ABSTRACT

A regulating system (110) for a horology movement (12) comprising a first sub-system (11) including:

- a first oscillator (O111) which includes a first balance (B111) and a first balance spring (S111);
- a first element (M111) for displacement of the first balance spring (S111); and
- a first element (A111) for activation of the first displacement element (M111), at an instant, or substantially at an instant, when the speed of the first balance (B111) is zero.

20 Claims, 6 Drawing Sheets

(56) References Cited

FOREIGN PATENT DOCUMENTS

| | | | |
|---|---|---|---|
| EP | 2 246 752 | A1 | 11/2010 |
| FR | 477837 | A | 11/1915 |
| FR | 1012356 | A | 7/1952 |
| WO | 00/04424 | A1 | 1/2000 |
| WO | 00/04425 | A1 | 1/2000 |
| WO | 01/59529 | A1 | 8/2001 |

* cited by examiner

REGULATING SYSTEM FOR A HOROLOGY MOVEMENT

The invention relates to a regulating system or regulator for a horology movement, or to a regulating system or regulator of a horology movement. The invention also relates to a horology movement comprising a regulating system of this type. The invention also relates to a horology piece, in particular a watch, comprising a movement or a regulating system of this type.

The oscillations of a regulating organ are commonly maintained by the impulses of an escapement. These impulses act directly or indirectly on the balance spring assembly, such as to provide it with kinetic energy.

This type of maintenance of the oscillations of a balance spring theoretically guarantees the isochronism of the horology piece, provided that the performance at the escapement is strictly the same at each impulse. However, as a result of the disruptions at the escapement or variations of the drive force produced by the drive organ, this condition is never perfectly fulfilled.

A free escapement is known from patent CH850, which is designed to maintain the oscillations of a balance directly by means of the balance spring. For this purpose, the outer end of the balance spring is secured on the end of a pallet which performs an oscillating movement similar to that of a pallet of a Swiss pallet escapement. The displacement of the outer end of the balance spring is therefore two-way, and probably zero throughout a period of the oscillator, which undoubtedly gives rise to a decrease in performance and instability of the amplitude of the balance. In addition, a device of this type does not make it possible to act on the balance spring at the instant when the balance reaches the end point of its oscillation. A solution of this type therefore leads to a significant isochronism defect.

A balance spring concept is also known from applications WO0004424 and WO0004425, wherein the oscillations are maintained partly or entirely by the displacement of the point of attachment of the outer end of the balance spring. More particularly, these applications relate to a device which can be assimilated to the family of "tourbillons", in which the rotation of the point of attachment of the outer end of the balance spring induces the rotation of the balance spring-escapement assembly. For this purpose, the balance spring stud of the balance spring is mounted on an escapement wheel, the frequency of rotation of which is defined by a lever or a pallet directly activated by the balance pin. This pin is positioned such that the tipping of the pallet, and therefore the rotation of the balance spring stud relative to the balance, preferably takes place at the instant when the balance is at maximum speed.

Patent application WO0159529 describes a variant design of the two aforementioned documents.

Document EP2246752 also describes a device of the same type.

In 2005, the watchmaker Christian Klings also proposed a tourbillon based on the same concept. Only the arrangement of the elements differs, with a pallet which is added directly onto the balance spring stud holder of the balance spring.

In the light of this prior art, it appears that escapements which are designed to vary the position of equilibrium of a balance spring assembly are formed so as to displace the outer end of the balance spring under the activation of an impulse generated by the balance itself. Generally, the impulse takes place at the instant when the balance is at maximum speed, in order to generate an adequate impulse. Although it is appropriate to generate the impulse at this instant for percussion escapements, so as not to affect adversely the period of the oscillator, the rule nevertheless differs for devices with variations of potential energy, with an impulse which should be imparted by the escapement when the amplitude of the balance is maximum, or when the speed of the balance is zero.

The object of the invention is to provide a regulating system which makes it possible to eliminate the aforementioned disadvantages, and to improve the regulating systems known in the prior art. In particular, the invention proposes a regulating system which permits modification of potential energy of the spring at an instant, or substantially at an instant, when the speed of the balance is zero.

According to the invention, a regulating system for a horology movement comprises a first sub-system coupled to a second sub-system, the first sub-system including:

- a first oscillator which includes a first balance and a first balance spring;
- a first element for displacement of the first balance spring, which is designed to displace an end or an attachment of the first balance spring under the effect of an impulse, in other words, a first displacement element of the first balance spring which is designed to impart an impulse to an end or to an attachment of the first balance spring, in order to modify its potential energy; and
- a first element for activation of the first displacement element, the activation taking place at an instant, or substantially at an instant, when the speed of the first balance is zero, i.e. at an instant, or substantially at an instant, when the balance is in a minimum or maximum angular position.

In other words, according to the invention, a regulating system for a horology movement comprises a first sub-system including:

- a first oscillator which includes a first balance and a first balance spring;
- a first element for displacement of the first balance spring; and
- a first element for activation of the first displacement element at an instant, or substantially at an instant, when the speed of the first balance is zero.

Different embodiments of a regulating system are defined by claims 2 to 17.

In some preferred embodiments, the system may comprise a second sub-system comprising:

- a second oscillator which includes a second balance and a second balance spring;
- a second element for displacement of the second balance spring; and
- a second element for activation of the second displacement element at an instant, or substantially at an instant, when the speed of the second balance is zero.

In particular, the regulating system can comprise a frame, and the first blocking lever can be pivoted on an axis which is fixed relative to the frame, or it can be pivoted on an axis which is mobile relative to the frame.

The second sub-system can be identical to the first sub-system, and the first activation element can be in interaction with the second oscillator and the second activation element can be in interaction with the first oscillator.

The regulating system can comprise a frame, and the first blocking wheel can be mounted such as to be mobile in rotation in a first cage, the first cage being mobile in rotation relative to the frame around the axis of the second balance.

The first blocking wheel can comprise a first pinion which engages with a first fixed planet wheel.

The first cage can engage with the first displacement element.

A horology movement according to the invention is defined by claim 18.

A horology piece according to the invention is defined by claims 19 and 20.

The appended drawings represent by way of example several variants of a first preferred embodiment of a regulating system according to the invention.

Figure 1:
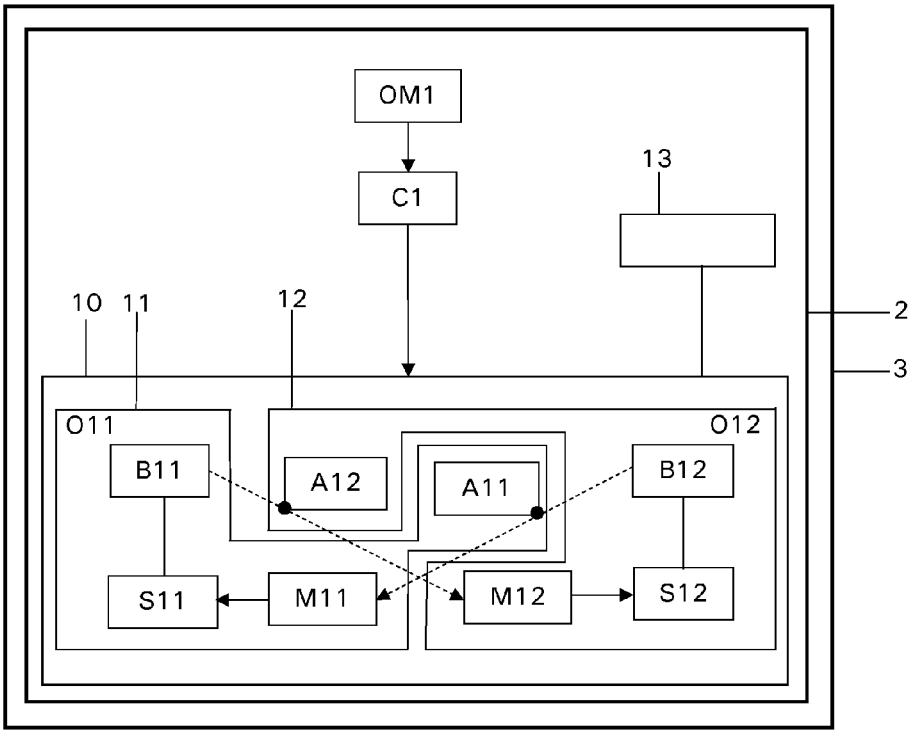
FIG. 1 is a schematic view of a preferred embodiment of a horology piece according to the invention, provided with a preferred embodiment of a regulating system according to the invention.

In each of the embodiments of the invention, it is proposed to couple a first oscillator with a second sub-system which preferably includes a second oscillator, and which oscillators suitably adjust their frequency, or the frequency of which is suitably adjusted, such as to act on one and/or the other of the two oscillators at appropriate instants. A regulating system of this type thus makes it possible to implement a substantially isochronous regulator, the oscillations of which are maintained by variations of potential energy. The actions on the oscillator(s) are actions of modification of potential energy.

The regulating system makes it possible to maintain a balance spring by means of variations of potential energy, and must therefore satisfy two a priori paradoxical conditions, i.e. it must be able to generate a sufficient impulse, so as to generate the displacement of the balance spring, and in particular the displacement of one end of the balance spring, for example the inner or outer end of the balance spring, and generate this impulse at an instant, or substantially at an instant, when the speed of the balance is zero, i.e. at an instant, or substantially at an instant, when the balance is in a minimum or maximum angular position. In addition, this minimum or maximum position of the balance is variable according to the positions of the horology piece, the load of the barrel, or also external effects such as impacts.

In order to obtain the maintenance of the oscillations, advantage is derived from the isochronous nature of the balance spring. In fact, this fundamental characteristic indicates that the instants when the speed of the balance is zero are repeated periodically, irrespective of the amplitude of the balance. It is therefore proposed to couple two oscillators which suitably adjust their frequency, or the frequency of which is suitably adjusted, such as to act on one and/or the other of the two oscillators at appropriate instants.

Thus, it is proposed to control a first balance spring of a first oscillator preferably by the assistance of a second oscillator, which is or is not mechanical, and imparts an impulse to it, in order to displace a first balance spring, in particular an attachment of a first balance spring, and in particular an attachment at one end of a balance spring of the first oscillator, at an instant, or substantially at an instant, when the speed of the first balance of the first oscillator is zero.

In some embodiments of the invention, the second oscillator is mechanical. It is proposed to control a second balance spring of the second oscillator by means of the first oscillator, which imparts an impulse to it, in order to displace a second balance spring, in particular an attachment of a second balance spring, and in particular an attachment at one end of a balance spring of the second oscillator, at an instant, or substantially at an instant, when the speed of the second balance of the second oscillator is zero.

A preferred embodiment of a horology piece 3, in particular a watch, and in particular a wristwatch, according to the invention, is described hereinafter with reference to FIG. 1. The horology piece comprises a movement 2, in particular a mechanical movement.

The movement 2 comprises a drive organ OM1, a regulating system 10 according to the invention, and a kinematic chain C1, the kinematic chain transmitting mechanical energy of the drive organ OM1 to the regulating system 10. The drive organ comprises a barrel for example.

The movement can also comprise a frame 13.

The regulating system 10 comprises a first sub-system 11 which includes:

- a first oscillator O11 including a first balance B11 and a first balance spring S11;
- a first element M11 for displacement of the first balance spring S11;
- a first element A11 for activation of the first element M11 for displacement at an instant, or substantially at an instant, when the speed of the first balance B11 is zero.

The first displacement element M11 makes it possible to supply an impulse to the first balance spring S11 by displacing the first balance spring, and in particular an attachment of the first balance spring. This attachment is preferably disposed at one end of the balance spring. This attachment can be constituted by one or a plurality of attachment points, or more generally by one or a plurality of connection elements.

The regulating system can also comprise the frame 13.

In the preferred embodiment of the regulating system, the regulating system 10 preferably comprises a second sub-system 12 which includes:

- a second oscillator O12 including a second balance B12 and a second balance spring S12;
- a second element M12 for displacement of the second balance spring S12;
- a second element A12 for activation of the second element M12 for displacement at an instant, or substantially at an instant, when the speed of the second balance B12 is zero.

In a manner similar to that of the description previously given, the second displacement element M12 makes it possible to supply an impulse to the second balance spring S12 by displacing the second balance spring, and in particular an attachment of the second balance spring. This attachment is preferably disposed at one end of the balance spring. As for the first balance spring, this attachment can be constituted by one or a plurality of attachment points, or more generally by one or a plurality of connection elements.

The first displacement element makes it possible to displace a point of the first balance spring. In other words, it therefore makes it possible to deform the first balance spring. Similarly, the second displacement element makes it possible to displace a point of the second balance spring. In other words, it therefore makes it possible to deform the second balance spring.

In some embodiments, it is proposed to couple two mechanical oscillators O11 and O12. The isochronous nature of these oscillators means that the instant when a balance is at maximum speed is offset by a quarter of a period relative to the instant when the speed of the balance is zero. It is therefore possible to couple two balance springs which ideally have the same natural frequency, or similar natural frequencies, and are dephased by a quarter of a period, such that they interact suitably. In a transitory regime of the regulating system, the two oscillators tend naturally to be offset by a quarter of a period. Thus, when the first balance B11 of the first oscillator O11 is at maximum speed, irrespective of its direction of rotation, it can supply an impulse via the second activation element A12 and the second element M12 for displacement of the second balance spring S12, to the second balance spring S12 of the second oscillator O12 at an instant, or substantially at an instant, when the speed of the second balance B12 is zero. Reciprocally, when the second balance B12 of the second oscillator O12 is at maximum speed, irrespective of its direction of rotation, it can supply an impulse via the first activation element A11 and the first element M11 for displacement of the first balance spring S11, to the first balance spring S11 of the first oscillator O11 at an instant, or substantially at an instant, when the speed of the first balance B11 is zero. The impulses supplied by the second oscillator O12 are thus preferably supplied by the interposition of the first activation element A11 and the first displacement element M11. For this purpose, the first activation element A11 is engaged discontinuously with the second balance B12. For this purpose, the first displacement element is engaged with the first balance spring S11 of the first oscillator O11. In a symmetrical manner, the impulses supplied by the first oscillator O11 are thus preferably supplied by the interposition of the second activation element A12 and the second displacement element M12. For this purpose, the second activation element A12 is engaged discontinuously with the first balance B12. For this purpose, the second displacement element is engaged with the second balance spring S12 of the second oscillator O12.

In some embodiments, it is thus proposed to control a first balance B1 and a first balance spring S11 of a first mechanical oscillator O11 by means of a second mechanical oscillator O12, and to control reciprocally a second balance B12 and a second balance spring S12 of the second mechanical oscillator O12 by means of the first mechanical oscillator O11. Thus, in each of the embodiments, the first and second sub-systems 11 and 12 preferably have symmetrical behavior. The second sub-system 12 is preferably identical to the first sub-system 11, the first activation element being in interaction with the second oscillator, and the second activation element being in interaction with the first oscillator.

In some alternative embodiments, it is proposed to control only a first balance B11 and a first balance spring S11 of a first mechanical oscillator O11, preferably by means of a second oscillator, which is or is not mechanical, connected to the activation element A11 of the first element M11 of the first sub-system 11. Preferably, the second oscillator is for example a horology quartz, the frequency of which is substantially higher than that of the first oscillator O11. The second oscillator is connected to the activation element A11 of the first element M11 of the first sub-system 11. Alternatively, the second oscillator can be substituted by a detector or a position sensor for cancellation of the speed of the balance B11. This sensor or detector is connected to the activation element A11 of the first element M11 of the first sub-system 11.

In a first embodiment of the regulating system, an attachment of the first balance spring is secured on a first displacement element, which is connected to the frame, and is displaceable relative to the frame. In other words, the first displacement element is mounted on the frame such that at least one movement or displacement of the first displacement element is permitted relative to the frame. It is therefore possible to displace an attachment of the first balance spring secured on the first displacement element, relative to the frame. Thus, the attachment of the first balance spring is connected to the frame, and is displaceable relative to the frame. The said attachment of the first balance spring is also displaceable relative to the first balance. The said attachment is preferably disposed at one end, in particular an outer end, of the first balance spring.

The displacements of the first displacement element can be one-way. Alternatively, its displacements can be two-way. In this case, the displacements can be symmetrical, or the displacements can be asymmetrical, i.e. their amplitude in one direction is different from their amplitude in the other direction. In particular, the displacement of the first displacement element is for example a rotation centered on the axis of rotation of the balance B11 according to a first and/or a second direction of rotation. The angular arc traveled by the balance spring S11, in particular by the attachment of the balance spring, which for example is disposed at one end of the balance spring, can differ according to the direction of rotation of the balance. The impulse can vary such as to give precedence to one or the other of the two directions of rotation of the attachment of the balance spring S11 throughout a period of the oscillator O11, and thus permit the displacement of the attachment of the balance spring S11 in a first or a second direction in at least one period of the oscillator O11. The displacement, in particular the distance or the angle of displacement, of the first element M11 can vary, in particular from one impulse to another of the first activation element A11.

In the first preferred embodiment of the regulating system according to the invention, in a manner similar to that of the description previously given with reference to the first subsystem, an attachment of the second balance spring is secured on a second displacement element which is connected to the frame, and is displaceable relative to the frame. In other words, the second displacement element is mounted on the frame such that at least one movement or displacement of the second displacement element is permitted relative to the frame. It is thus possible to displace an attachment of the second balance spring, which attachment is secured on the second displacement element, relative to the frame. Thus, the attachment of the second balance spring is connected to the frame and is displaceable relative to the frame. The said attachment of the second balance spring is consequently displaceable relative to the second balance. The said attachment is preferably disposed at an end, in particular an outer end, of the second balance spring.

As is the case for the first displacement element, the displacement of the second displacement element is for example a rotation centered on the axis of rotation of the balance B12 according to a first and/or a second direction of rotation. The angular arc traveled by the balance spring S12, in particular by the attachment of the balance spring, which for example is disposed at one end of the balance spring, can differ according to the direction of rotation of the balance. The impulse can vary such as to give precedence to one or the other of the two directions of rotation of the attachment of the balance spring S12 throughout a period of the oscillator O12, and thus permit the displacement of the attachment of the balance spring S12 in a first or a second direction in at least one period of the oscillator O11. The displacement, in particular the distance or the angle of displacement of the second element M12 can vary, in particular from one impulse to another of the second activation element A12.

Figure 2:
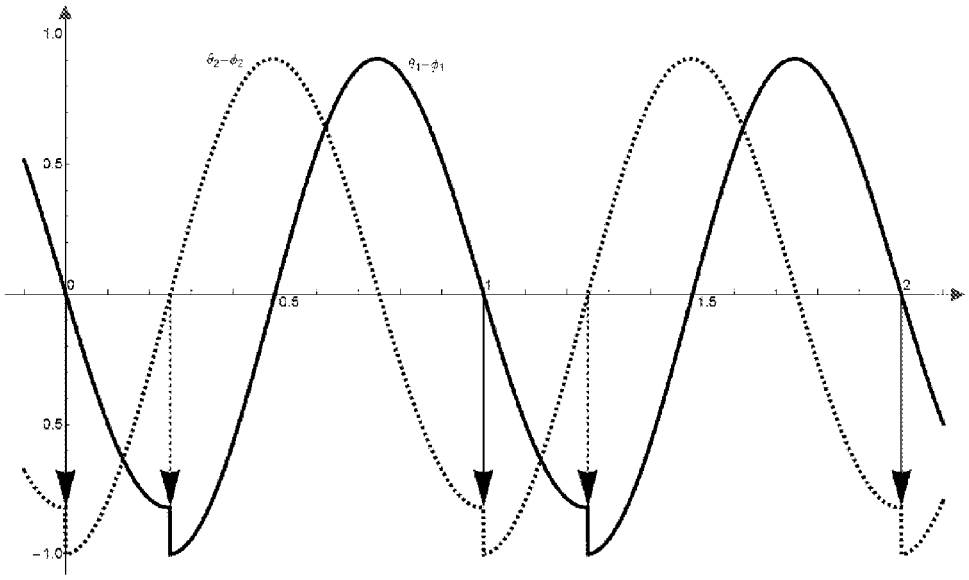
FIGS. 2 and 3 are graphs representing temporal developments of the angular positions of two balances of the first preferred embodiment of the regulating system.

By way of illustration, FIG. 2 schematizes a specific functioning mode of the first preferred embodiment of the regulating system according to the invention, wherein the first oscillator acts on the second oscillator for a single direction of rotation of the first balance. The second oscillator acts on the first oscillator for a single direction of rotation of the second balance. The curve in a solid line illustrates the development of the positions of the first oscillator. The curve in a dotted line illustrates the development of the positions of the second oscillator. Arrows in a solid line indicate the impulse of the first oscillator on the second oscillator. Other arrows in dotted lines indicate the impulse of the second oscillator on the first oscillator.

The Y axis of the graph in FIG. 2 indicates the terms $\theta_1-\Phi_1$, $\theta_2-\Phi_2$ representing the angular arc traveled respectively by the balances B11, B12 relative to the attachment of their balance spring S11, S12 on the frame, where $\theta_1$, $\theta_2$ is the angular arc traveled by the balance B11, B12 seen from a fixed reference point of the frame of the horology piece, and $\Phi_1$, $\Phi_2$ is the angular arc traveled by the outer end of each balance spring S11, S12 seen from a fixed reference point of the horology piece.

Thus, according to a specific functioning mode of the preferred embodiment in FIG. 1, an impulse induces a sudden change of the term $\theta_2-\Phi_2$ when the balance B12 reaches its minimum angular position. Reciprocally, an impulse induces a sudden change of the term $\theta_1-\Phi_1$ when the balance B11 reaches its minimum angular position.

A variant embodiment of this type can be characterized by implementation of the following equation:

$$i_1\ddot{\theta}_1+c_1\dot{\theta}_1+k_1(\theta_1-\phi_1)=0$$

$$i_2\ddot{\theta}_2+c_2\dot{\theta}_2+k_2(\theta_2-\phi_2)=0$$

$$\dot{\phi}_1=\Phi_1\text{delta}(\theta_2-\phi_2)\text{abs}(\dot{\theta}_2-\dot{\phi}_2)1+\text{sign}(\dot{\theta}_2-\dot{\phi}_2)/2$$

$$\dot{\phi}_2=\Phi_2\text{delta}(\theta_1-\phi_1)\text{abs}(\dot{\theta}_1-\dot{\phi}_1)1+\text{sign}(\dot{\theta}_1-\dot{\phi}_1)/2$$

$i_1$, $i_2$, $c_1$, $c_2$, $k_1$, $k_2$ are respectively the inertias, viscous frictions and rigidities of each of the oscillators O11, O12. $\Phi_1$, $\Phi_2$ is the increment of rotation of the attachment of the balance spring S11, S12. The delta function is a dirac. The sign function is such that the image of x according to this function is equal to:

−1 for any x<0;
0 for x=0;
1 for any x>0.

The following equation generalizes this specific functioning mode, with four possible impulses per functioning cycle:

$$i_1\ddot{\vartheta}_1+c_1\dot{\vartheta}_1+k_1(\vartheta_1-\phi_1)=0$$

$$i_2\ddot{\vartheta}_2+c_2\dot{\vartheta}_2+k_2(\vartheta_2-\phi_2)=0$$

$$\dot{\phi}_1=\text{delta}(\vartheta_2-\phi_2)\text{abs}(\dot{\vartheta}_2-\dot{\phi}_2)\left(\Phi_1^+\frac{1+\text{sign}(\dot{\vartheta}_2-\dot{\phi}_2)}{2}+\Phi_1^-\frac{1-\text{sign}(\dot{\vartheta}_2-\dot{\phi}_2)}{2}\right)$$

$$\dot{\phi}_2=\text{delta}(\vartheta_1-\phi_1)\text{abs}(\dot{\vartheta}_1-\dot{\phi}_1)\left(\Phi_2^+\frac{1+\text{sign}(\dot{\vartheta}_1-\dot{\phi}_1)}{2}+\Phi_2^-\frac{1-\text{sign}(\dot{\vartheta}_1-\dot{\phi}_1)}{2}\right)$$

$i_{1,2}$, $c_{1,2}$, $k_{1,2}$ are respectively the inertias, viscous frictions and rigidities of each of the oscillators O11, O12. $\Phi_1^+$, $\Phi_1^-$, $\Phi_2^+$, $\Phi_2^-$ is the increment of rotation of the attachment of the balance spring S11, S12 on the frame, with the sign of the increment indicating the minimum or maximum angular position of the balance B11, B12. The delta function is a dirac. The sign function is such that the image of x according to this function is equal to:

−1 for any x<0;
0 for x=0;
1 for any x>0.

Figure 3:
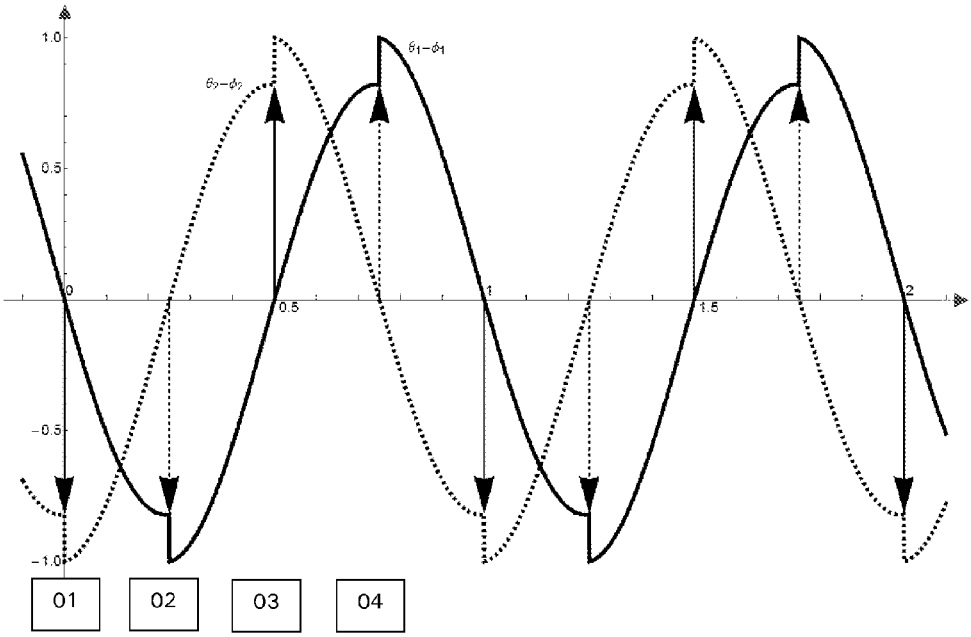

An equation of this type can for example be schematized by FIG. 3, which represents a functioning sequence of the oscillators O11, O12 illustrated respectively by two curves, in two periods of oscillation. The curve in a solid line illustrates the development of the positions of the first oscillator O11. The curve in a dotted line illustrates the development of the positions of the second oscillator O12. Arrows in a solid line indicate the detection of the transition to zero of the first oscillator and the impulse on the second oscillator. Other arrows in dotted lines indicate the reciprocity. The Y axis of the graph in FIG. 3 indicates the terms $\theta_1-\Phi_1$, $\theta_2-\theta_2$ representing the angular arc traveled respectively by the balances B11, B12 relative to the attachment of their balance spring S11, S12, where $\theta_1$, $\theta_2$ is the angular arc traveled by the balance B11, B12 seen from a fixed reference point of the frame of the horology piece, and $\Phi_1$, $\Phi_2$ is the angular arc traveled by the outer end of the balance spring S11, S12 seen from a fixed reference point of the horology piece.

Advantageously, the first and second oscillators are supplied with energy by the same drive organ OM1 and by means of the same kinematic chain C1. Alternatively, two kinematic chains can be provided to supply the oscillators with energy from a single drive organ. Preferably, an energy distribution device, for example a differential gear or a planetary gear train is provided in a kinematic chain, such as to supply the first and second oscillators equitably. Alternatively, two drive organs can be provided to supply each of the first and second oscillators. Drive organ means for example one or a plurality of barrels.

A first variant of the preferred embodiment is illustrated hereinafter with reference to FIGS. 4 to 11. In this variant, the aforementioned elements have a "1" at the beginning of their reference number or at the beginning of the numerical sequence of their alphanumerical reference. In this variant, the horology piece 13, in particular a watch, and in particular a wristwatch, comprises a movement 12, in particular a mechanical movement. This movement itself comprises a regulating system 110.

The regulating system 110 has the following particular features.

The first displacement element M111 comprises a first lever which is articulated around the axis of rotation of the first balance B111. The second displacement element M112 comprises a second lever which is articulated around the axis of rotation of the second balance B112. The first displacement element comprises a first balance spring stud holder. Similarly, the second displacement element comprises a second balance spring stud holder.

The first activation element A111 of the first displacement element comprises a first drive element E111 of the first displacement element, and a first triggering element D111 of the first drive element. The second activation element A112 of the second displacement element comprises a second drive element E112 of the second displacement element, and a second triggering element D112 of the second drive element.

The first and second activation elements of the displacement elements are designed to activate the displacement elements at instants, or substantially at instants, when the speed of one of the balances is zero. This condition is fulfilled when a balance is in an end position. However, the end positions of the balances develop according to many criteria. It is possible to offset the two oscillators by a quarter of a period by implementing the activation elements described hereinafter.

It should be noted that the two oscillators need not have strictly the same natural frequency. In this case, this results in a natural frequency value of the regulating system contained between the two natural frequency values of the two oscillators. In a transitory regime of the regulating system, the two oscillators can have different functioning frequencies, and the oscillations of the two balances can be offset by a value which differs by a quarter of a period. However, these frequencies tend naturally to equalize, and the oscillations tend to be offset by a quarter of a period in order to reach a permanent regime.

The first drive element E111 comprises a first lever L111 and a first cam CA111. The first lever L111 cooperates with a first cam CA111 which is rotated by the drive organ via a kinematic chain C11. The second drive element E112 comprises a second lever L112 and a second cam CA112. The second lever L112 cooperates with a second cam CA112 which is rotated by the drive organ via a kinematic chain.

The first lever L111 comprises a first follower L121 which is brought back into contact with the first cam by a first resilient element R111, for example a spring. Complementarily, the first lever L111 comprises a first obstacle element GL111 which cooperates as an obstacle with the first displacement element M111. For example, the first obstacle element GL111 is a first pin which cooperates with a first fork provided on the first displacement element M111. Any other engagement means can be suitable. The first lever is pivoted on the frame 113 at the level of an axis 131. The first lever comprises for example the first follower at one of its ends, and the first obstacle element GL111 at the other one of its ends.

The second lever L112 comprises a second follower L122 which is brought back into contact with the second cam by a second resilient element R112, for example a spring. Complementarily, the second lever L112 comprises a second obstacle element GL112 which cooperates as an obstacle with the second displacement element M112. For example, the second obstacle element GL112 is a second pin which cooperates with a second fork provided on the second displacement element M112. Any other engagement means can be suitable. The second lever is pivoted on the frame 113 at the level of an axis 132. The second lever comprises for example the second follower at one of its ends, and the second obstacle element GL112 at the other one of its ends. The first and/or the second resilient element can be a spring, as previously described. Alternatively, it can also be integral with the lever(s), such as to define a flexible rotation guide, and thus implement a bistable lever.

The first triggering element E111 comprises a first blocking lever BL111 of a first blocking wheel RB111 which is integral with the first cam CA111. The first blocking wheel RB111 and the first cam CA111 are for example mounted secured on one another on a common axis. The second triggering element E112 comprises a second blocking lever BL112 of a second blocking wheel RB112 which is integral with the second cam CA112. The second blocking wheel RB112 and the second cam CA112 are for example mounted secured on one another on a common axis.

The first blocking lever BL111 comprises a third fork which cooperates with a first pin provided on the second balance, in particular on a second plate of the second balance. The first blocking lever has two stable positions, in each of which a stop pallet blocks the rotation of the first blocking wheel RB111 by acting as an obstacle against one of its teeth. The second blocking lever BL112 comprises a fourth fork which cooperates with a second pin provided on the first balance, in particular on a first plate of the first balance. The second blocking lever has two stable positions, in each of which a stop pallet blocks the rotation of the second blocking wheel RB112 by acting as an obstacle against one of its teeth.

The first blocking lever is pivoted on an axis 141 which is fixed relative to the frame. Similarly, the second blocking lever is pivoted on an axis 142 which is fixed relative to the frame. The first and second blocking levers can have the global geometry of a Swiss pallet, or they can have the global geometry of an escapement blocking lever of the Robin type, or any other suitable geometry. However, it should be noted that the blocking lever is not an escapement pallet or an escapement blocking lever, in that no impulse plane is provided, either on the teeth of the blocking wheels, or on the pallets of the blocking levers. Thus, the cooperation of the blocking levers and the blocking wheels takes place without transmission, or substantially without transmission, of energy of the blocking wheels to the blocking levers when the regulating system is functioning. It would nevertheless be possible to form the blocking levers and the blocking wheels such that the blocking wheels transmit energy to the blocking levers in the transitory regime of the regulating system.

Figure 4:
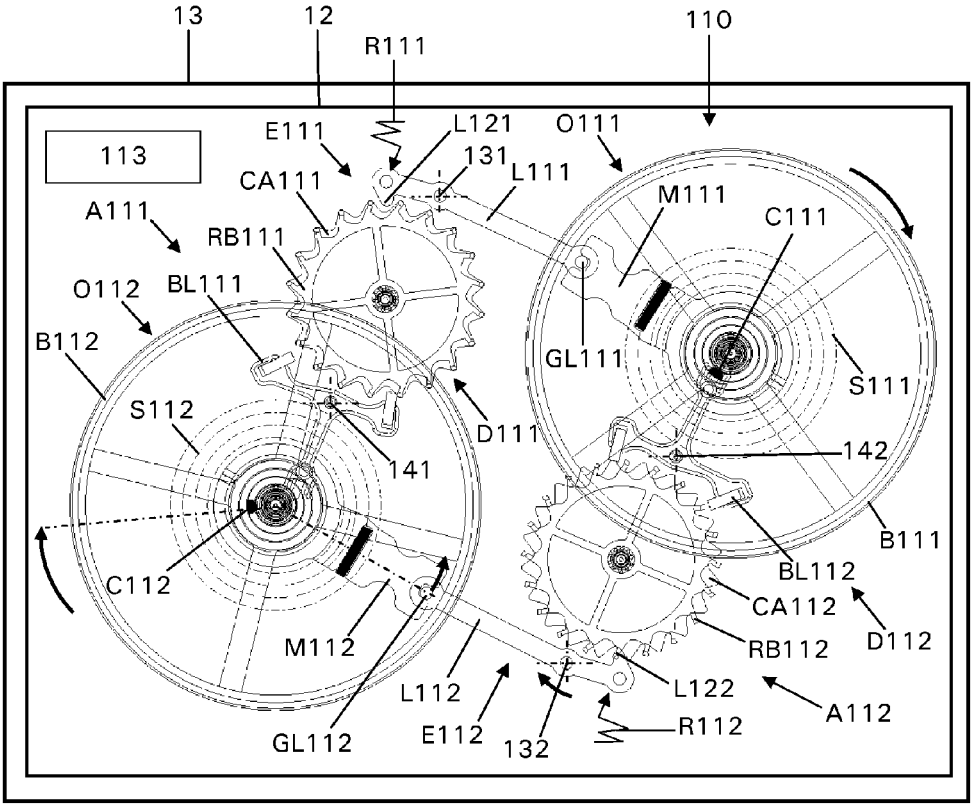
FIGS. 4 to 11 are views of a first variant of the first preferred embodiment of the regulating system in different states, these views illustrating the functioning of the regulating system.

The functioning of the first variant of the first preferred embodiment of the regulating system represented in FIG. 4 is described hereinafter with reference to FIGS. 3 to 11.

Each displacement element of a sub-system is activated by means of an activation element and the kinematic chain. This activation is commanded by the position of the balance of the other sub-system. In fact, via the plate pin of the other balance, the blocking lever can be displaced from a first stable position to a second stable position. This change of position of the blocking lever permits the rotation by a specific angle of the blocking wheel, and, consequently, a displacement of the balance spring stud holder present on the displacement element, via an activation element.

The regulating system thus implements blocking levers BL111, BL112 which are mobile in both directions of rotation, and balance spring stud holders which are also mobile in rotation in both directions of rotation. The first balance B111 of the first oscillator O111 acts, or more accurately commands action, on the second balance spring S112 of the second oscillator O112, irrespective of its direction of rotation. Reciprocally, the second balance B112 of the second oscillator O112 acts on the first balance spring S111 of the first oscillator O111, irrespective of its direction of rotation.

At an instant 01 shown in FIG. 3, the first balance B111 is displaced at maximum speed in an anti-trigonometric direction (as represented in FIG. 4). The first plate pin C111 of the first balance B111 comes into contact with the fork of the second blocking lever BL112, such that the displacement of the first balance B111 permits the rotation of the second blocking wheel RB112 which cooperates with the second blocking lever BL112. The second cam CA112 has a binary profile. The second cam CA112, which is mounted integrally in rotation with the second blocking wheel RB112, makes it possible to control the position of the second balance spring stud holder, by means of the lever L112 and the associated return spring R112.

In the configuration illustrated in FIG. 4, an impulse is thus in the process of being supplied to the second displacement element M112 which supports the second balance spring stud holder. This is carried out by means of the energy which is obtained from the drive organ, and reaches the second blocking wheel RB112 and the second cam CA112 via the kinematic chain. In fact, the rotation of the second cam CA112 gives rise to a mechanical action on the second cam follower L122 and pivoting of the second lever L112 in the anti-trigonometric direction. The action of the pin GL112 on the second displacement element M112 gives rise to displacement in the trigonometric direction of the second displacement element. The second balance spring S112 is in a maximum winding configuration. The displacement in rotation of the second balance spring stud holder M112 in the trigonometric direction around the axis of rotation of the second balance B112 gives rise to the winding of the second balance spring S112 by an additional angular arc. This impulse can be considered instantaneous, in that the interaction time of the plate pin C111 with the fork of the second blocking lever BL112 is approximately 10 ms for an oscillator with a frequency of approximately 4 Hz.

Figure 5:
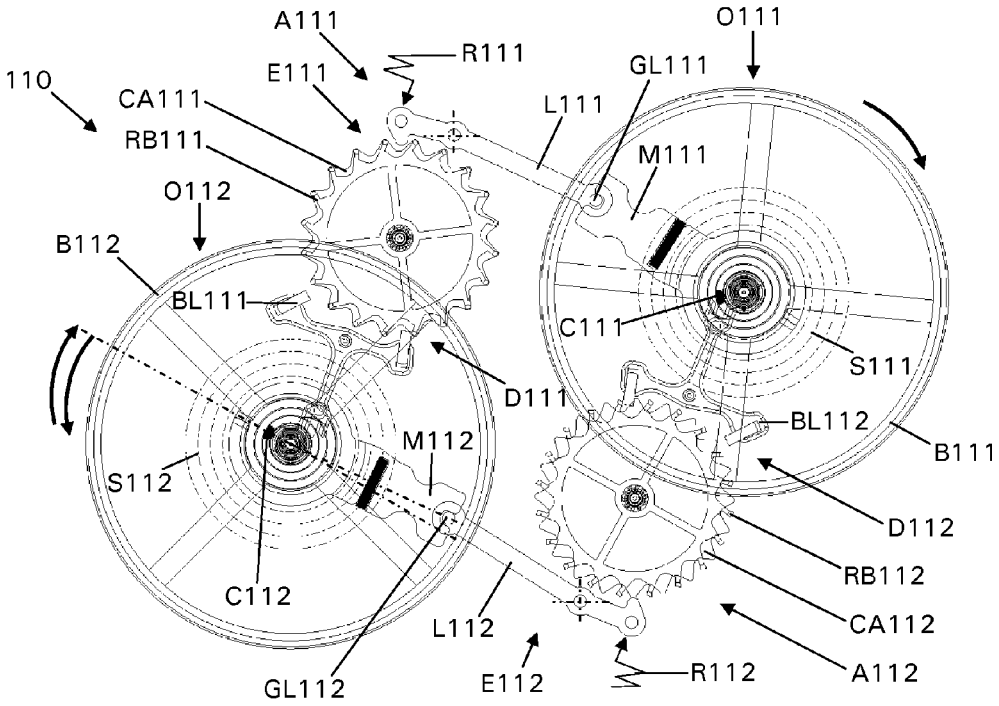

FIG. 5 illustrates the regulating system at the instant when the first pin C111 is released from the fork of the second blocking lever BL112. This instant coincides substantially with the instant when the balance B112 reaches a minimum angular position where the direction of rotation of the balance B112 is inverted. The respective positions of the second blocking lever BL112, the second blocking wheel RB112, the second cam CA112, the second lever L112 and the second displacement element M112 are stabilized. Thus, the position of the outer end of the second balance spring S112 is perfectly defined for alternation of the second balance B112.

Figure 6:
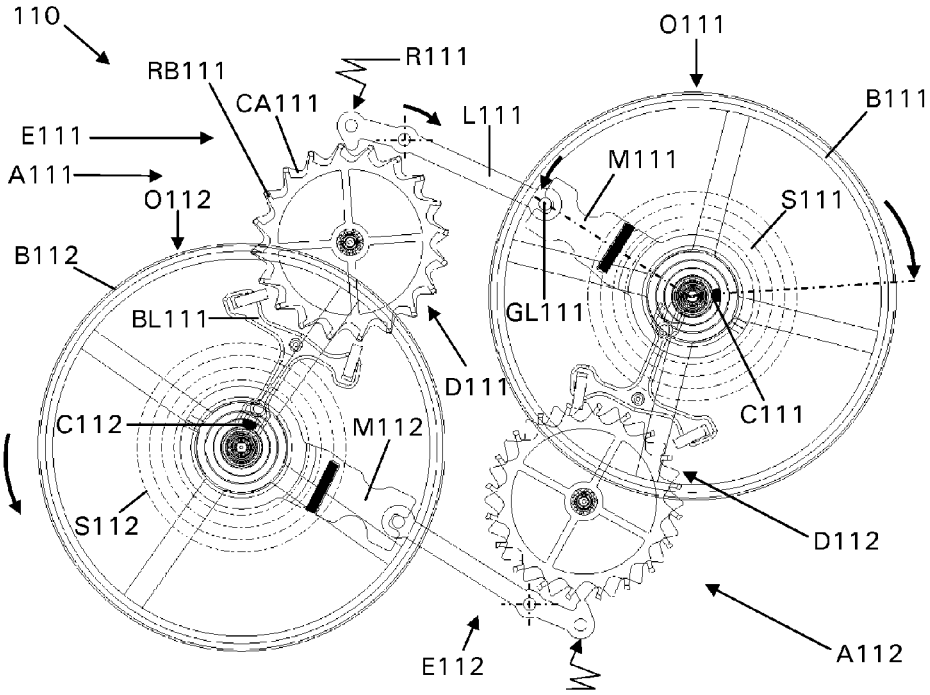

At an instant 02 indicated in FIG. 3, the second balance B112 is displaced at maximum speed in the trigonometric direction (as represented in FIG. 6). The second plate pin C112 of the second balance B112 comes into contact with the fork of the first blocking lever BL111, such that the displacement of the second balance B112 permits the rotation of the first blocking wheel RB111 which cooperates with the first blocking lever BL111. The first cam CA111 has a binary profile. The first cam CA111 which is mounted integrally in rotation with the first blocking wheel RB111 makes it possible to control the position of the first balance spring stud holder by means of the first lever L111 and the associated return spring R111.

In the configuration illustrated in FIG. 6, an impulse is thus in the process of being supplied to the first displacement element M111 which supports the first balance spring stud holder. This is carried out by the energy which is obtained from the drive organ, and reaches the level of the first blocking wheel RB111 and the first cam CA111 via the kinematic chain. In fact, the rotation of the first cam CA111 gives rise to mechanical action on the first cam follower L121 and to pivoting of the first lever L111 in the trigonometric direction. The action of the pin GL111 on the first displacement element M111 gives rise to displacement in the anti-trigonometric direction of the first displacement element. The first balance spring S111 is in a configuration of maximum winding. The displacement in rotation of the first balance spring stud holder M111 in the trigonometric direction around the axis of rotation of the first balance B111 gives rise to the winding of the first balance spring S111 by an additional angular arc. This impulse can be considered instantaneous, in that the interaction time of the plate pin C112 with the fork of the first blocking lever BL111 is approximately 10 ms for an oscillator with a frequency of approximately 4 Hz.

Figure 7:
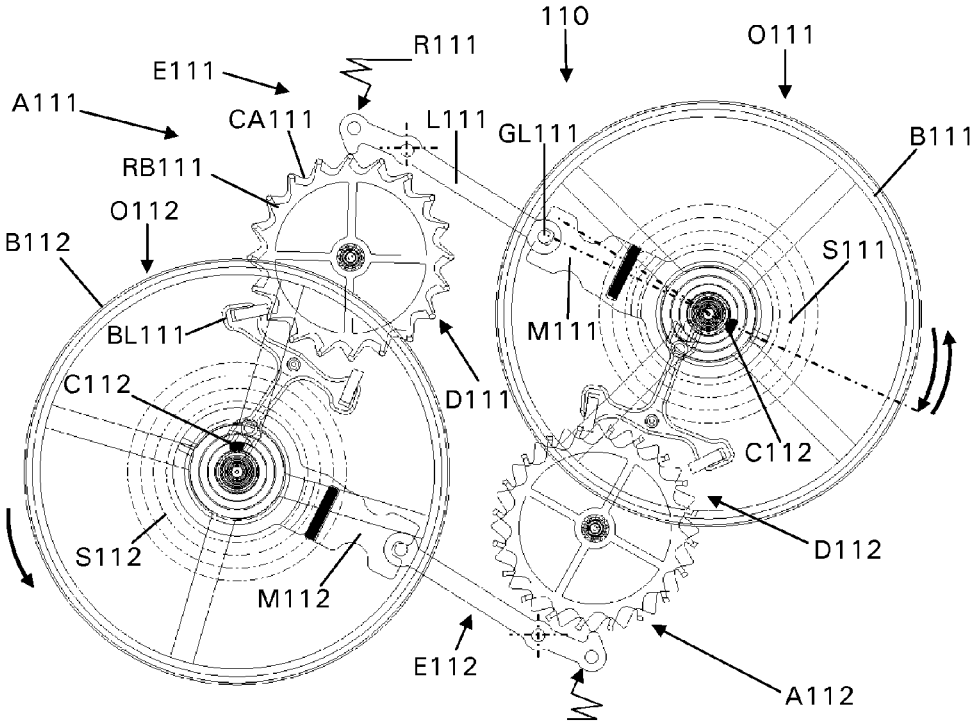

FIG. 7 illustrates the regulating system at the instant when the second pin C112 is released from the fork of the first blocking lever BL111. This instant coincides substantially with the instant when the balance B111 reaches a minimum angular position where the direction of rotation of the balance B111 is inverted. The respective positions of the first blocking lever BL111, the first blocking wheel RB11, the first cam CA111, the first lever L111 and the first displacement element M111 are stabilized. Thus, the position of the outer end of the first balance spring S111 is perfectly defined for alternation of the first balance B111.

Figure 8:
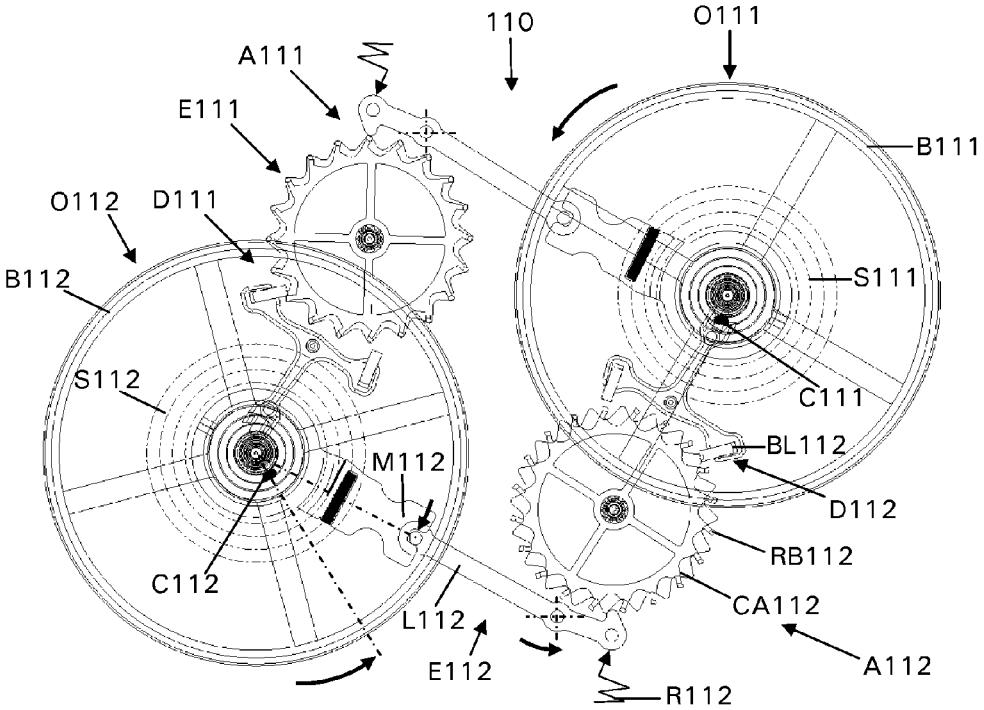

At an instant 03 indicated in FIG. 3, the first balance B111 is displaced at maximum speed in the trigonometric direction (as represented in FIG. 8). The first plate pin C111 of the first balance B111 comes into contact with the fork of the second blocking lever BL112, such that the displacement of the first balance B111 permits the rotation of the second blocking wheel RB112 which cooperates with the second blocking lever BL112. The second cam CA112 which is mounted integrally in rotation with the second blocking wheel RB112 makes it possible to control the position of the second balance spring stud holder by means of the lever L112 and the associated return spring R112.

In the configuration illustrated in FIG. 8, an impulse is thus in the process of being supplied to the second displacement element M112 which supports the second balance spring stud holder. This is carried out by means of the energy which is obtained from the spring 8112. In fact, because of its profile, the rotation of the second cam CA112 gives rise to displacement of the second cam follower L122 and pivoting of the second lever L112 in the trigonometric direction. This displacement is carried out under the action of the spring R112. The action of the pin GL112 on the second displacement element M112 gives rise to displacement in the anti-trigonometric direction of the second displacement element. The second balance spring S112 is in a maximum extension configuration. The displacement in rotation of the second balance spring stud holder M112 in the anti-trigonometric direction around the axis of rotation of the second balance B112 gives rise to the extension of the second balance spring S112 by an additional angular arc. This impulse can be considered instantaneous, in that the interaction time of the plate pin C111 with the fork of the second blocking lever BL112 is approximately 10 ms for an oscillator with a frequency of approximately 4 Hz.

Figure 9:
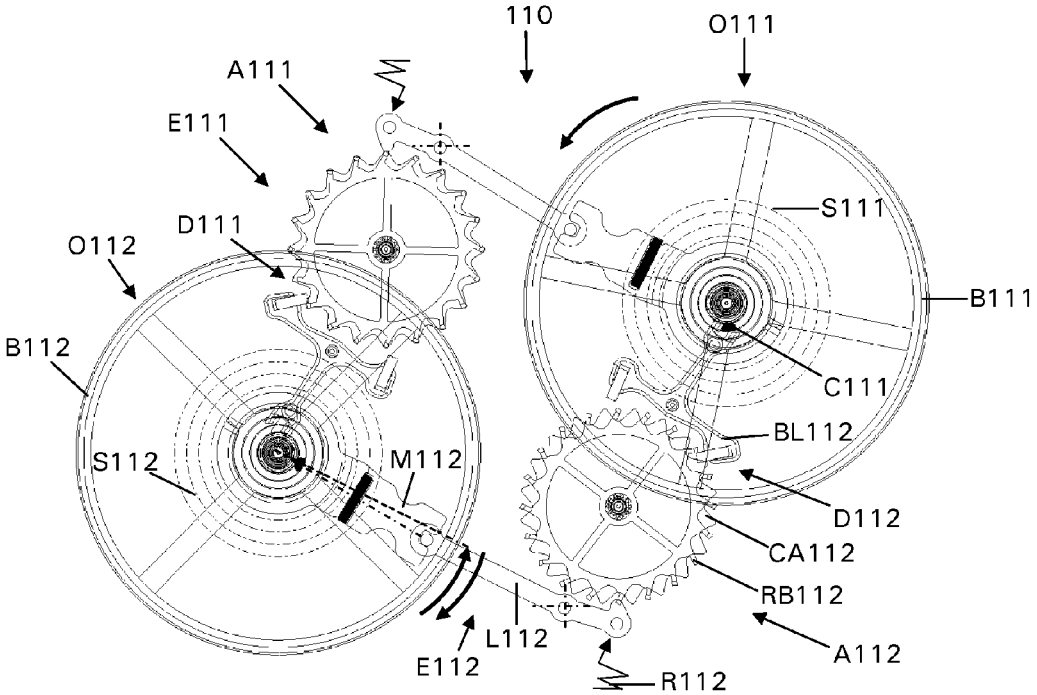

FIG. 9 illustrates the regulating system at the instant when the first pin C111 is released from the fork of the second blocking lever BL112. This instant coincides substantially with the instant when the balance B112 reaches a maximum angular position where the direction of rotation of the balance B112 is inverted. The respective positions of the second blocking lever BL112, the second blocking wheel RB112, the second cam CA112, the second lever L112 and the second displacement element M112 are stabilized. Thus, the position of the outer end of the second balance spring S112 is perfectly defined for alternation of the second balance B112.

Figure 10:
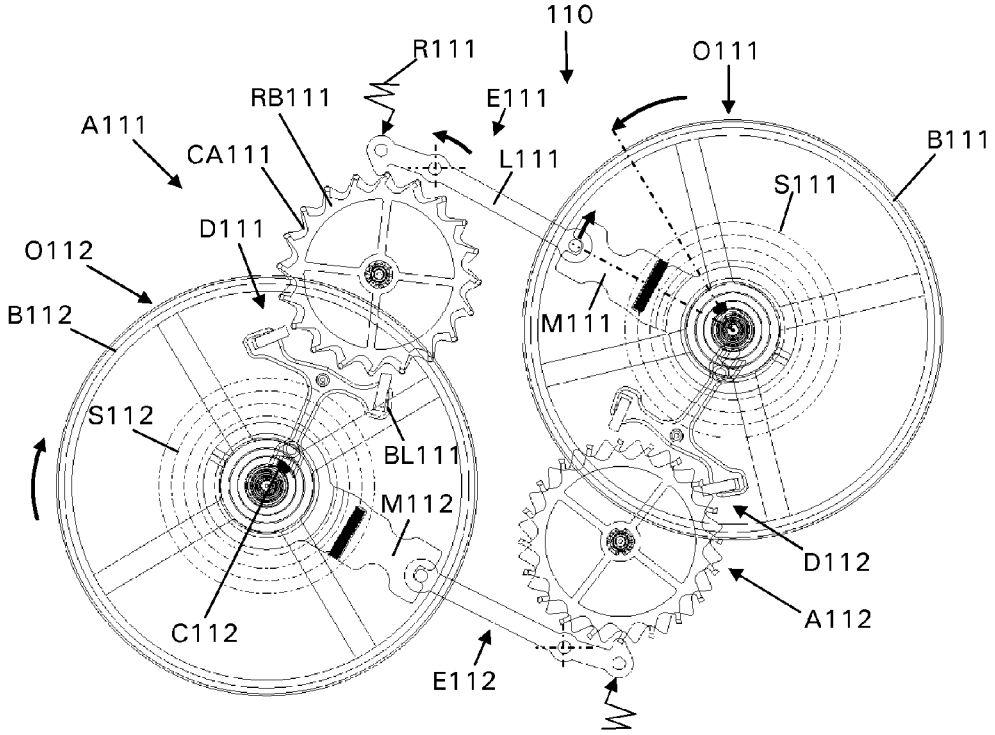

At an instant 04 indicated in FIG. 3, the second balance B112 is displaced at maximum speed in the anti-trigonometric direction (as represented in FIG. 10). The second plate pin C112 of the second balance B112 comes into contact with the fork of the first blocking lever BL111, such that the displacement of the second balance B112 permits the rotation of the first blocking wheel RB111 which cooperates with the first blocking lever BL111. The first cam CA111 which is mounted integrally in rotation with the first blocking wheel RB111 makes it possible to control the position of the first balance spring stud holder by means of the first lever L111 and the associated return spring R111.

In the configuration illustrated in FIG. 10, an impulse is thus in the process of being supplied to the first displacement element M111 which supports the first balance spring stud holder. This is carried out by the energy which is obtained from the spring R111. In fact, because of its profile, the rotation of the first cam CA111 gives rise to displacement of the first cam follower L121 and to pivoting of the first lever L111 in the trigonometric direction. This displacement is carried out under the action of the spring R111. The action of the pin GL111 on the first displacement element M111 results in displacement of the first displacement element in the anti-trigonometric direction. The first balance spring S111 is in a configuration of maximum extension. The displacement in rotation of the first balance spring stud holder M111 in the anti-trigonometric direction around the axis of rotation of the first balance B111 gives rise to the extension of the first balance spring S111 by an additional angular arc. This impulse can be considered instantaneous, in that the interaction time of the plate pin C112 with the fork of the first blocking lever BL111 is approximately 10 ms.

Figure 11:
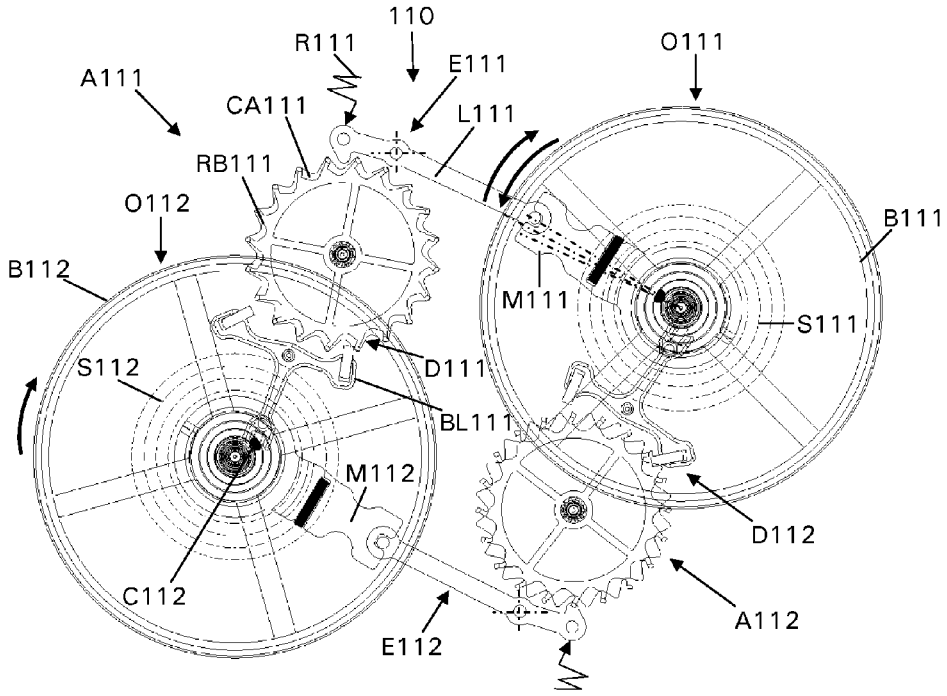

FIG. 11 illustrates the regulating system at the instant when the second pin C112 is released from the fork of the first blocking lever BL111. This instant coincides substantially with the instant when the balance B111 reaches a maximum angular position where the direction of rotation of the balance B111 is inverted. The respective positions of the first blocking lever BL111, the first blocking wheel RB111, the first cam CA111, the first lever L111 and the first displacement element M111 are stabilized. Thus, the position of the outer end of the first balance spring S111 is perfectly defined for alternation of the first balance B111.

The angular amplitude of each of the balance spring stud holders M111, M112 can be between 1° and 15°, and in particular between 5° and 10°, for example approximately 7°.

Figure 12:
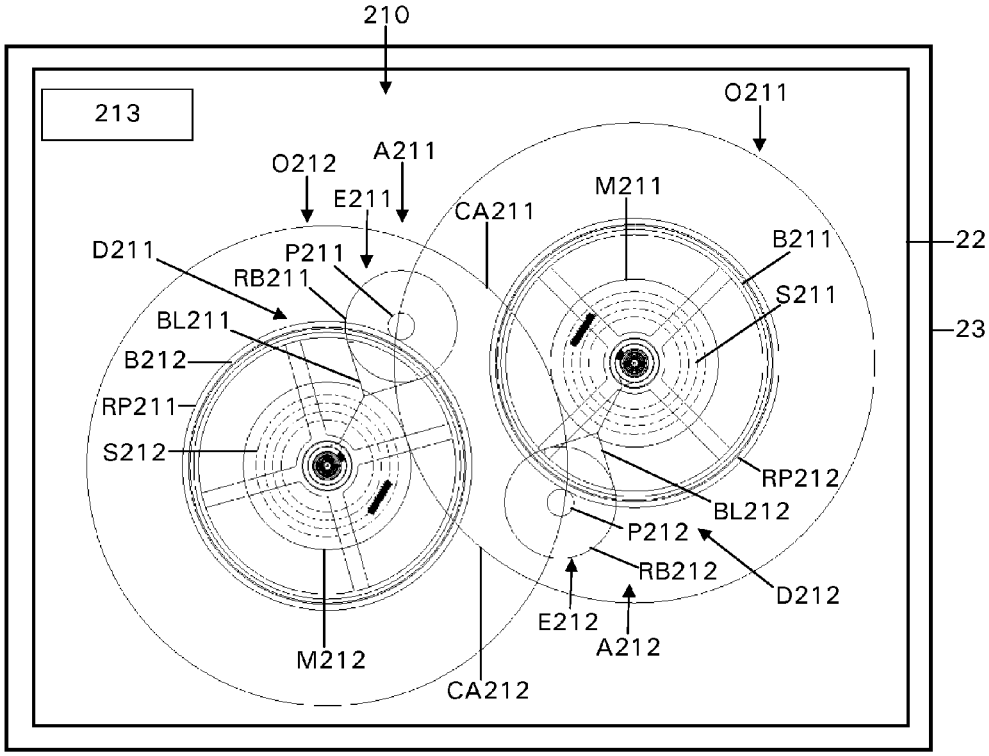
FIG. 12 is a view of a second variant of the first preferred embodiment of the regulating system.

A second variant of the first preferred embodiment is described hereinafter with reference to FIG. 12. In this second variant, the elements which are identical or have the same function as the elements of the first variant have a "2" at the beginning of their numerical reference instead of a "1", or at the beginning of the numerical sequence of their alphanumerical reference. In this variant, the horology piece 23, in particular a watch, and in particular a wristwatch, comprises a movement 22, in particular a mechanical movement. This movement itself comprises a regulating system 210.

The regulating system 210 comprises a first sub-system 211. This first sub-system comprises the first oscillator O211, a first element M211 for displacement of the first balance spring S211, and a first element A211 for activation of the first displacement element at an instant, or substantially at an instant, when the speed of the first balance B211 is zero. The first oscillator O211 includes a first balance B211 and a first balance spring S211.

The regulating system 210 comprises a second sub-system 212. This second sub-system comprises the second oscillator O212, a second element M212 for displacement of the second balance spring S212, and a second element A212 for activation of the second displacement element at an instant, or substantially at an instant, when the speed of the second balance B212 is zero. The second oscillator O212 includes a second balance B212 and a second balance spring S212.

In comparison with the regulating system 110, the regulating system 210 has the following particular features.

In the regulating system 210, the first blocking wheel RB211 is mounted such as to be mobile in rotation in a first cage CA211. The first cage is mobile in rotation relative to the frame 213 around the axis of the second balance B212. Similarly, the second blocking wheel RB212 is mounted such as to be mobile in rotation in a second cage CA212. The second cage is mobile in rotation relative to the frame 213 around the axis of the first balance B211.

The first blocking wheel RB211 comprises a first pinion P211 which engages with a first planet wheel RP211 which is fixed relative to the frame. The first planet wheel RP211 is centered on the axis of the second balance B212. In parallel, the second blocking wheel RB212 comprises a second pinion P212 which engages with a second planet wheel RP212 which is fixed relative to the frame. The second planet wheel RP212 is centered on the axis of the first balance B211.

The first cage CA211 engages with the first displacement element M211. The first displacement element can be a first wheel or can include a first wheel. The first displacement element can be pivoted on the axis of the first balance wheel. Similarly, the second cage CA212 engages with the second displacement element M212. The second displacement element can be a second wheel or can include a second wheel. The second displacement element can be pivoted on the axis of the second balance wheel.

As in the first variant, the first and second blocking levers can have the global geometry of a Swiss pallet, or they can have the global geometry of an escapement blocking lever of the Robin type, or any other suitable geometry. As in the first variant, it should however be noted that the blocking lever is not an escapement pallet or an escapement blocking lever. It would nevertheless be possible to form the blocking levers and the blocking wheels such that the blocking wheels transmit energy to the blocking levers in the transitory regime of the regulating system.

In this second variant, the first blocking lever is pivoted on an axis which is mobile relative to the frame. Similarly, the second blocking lever is pivoted on an axis which is mobile relative to the frame.

In this case, the activation of the first displacement element M211 is carried out directly or indirectly by the first cage CA211, the rotation of which is controlled by the first blocking wheel RB211 under the effect of the plate pin of the second balance B212. Similarly, in this case, the activation of the second displacement element M212 is carried out directly or indirectly by the second cage CA212, the rotation of which is controlled by the second blocking wheel RB212 under the effect of the plate pin of the first balance B211. The rotation of each of the balance spring stud holders is thus one-way. The mechanical impulses must therefore vary such as to give precedence to one or the other of the two directions of rotation of the outer end of the balance spring throughout a period of the oscillator, and thus permit the displacement of the outer end of the balance spring in a first or a second direction throughout the functioning cycle of the oscillator. For this purpose, the blocking levers must have asymmetrical behavior. Thus, in the first embodiment, the amplitude of the displacement of the blocking lever can be variable according to its direction of displacement.

In a second embodiment of the regulating system according to the invention, it is proposed to control the first displacement element of the first embodiment preferably by means of a second oscillator. For this purpose, the activation element is connected to, or associated with, a second oscillator. Preferably, the second oscillator is for example a horology quartz, the frequency of which is substantially higher than that of the first mechanical oscillator. The activation element comprises a triggering element and a drive element. More specifically, the second oscillator is connected to the triggering element. The triggering element comprises a frequency divider. The signal obtained from the frequency divider has a frequency which is substantially the same as that of the first oscillator. The frequency of this signal can also be a multiple or a divider of the frequency of the first oscillator. This signal controls the drive element. This drive element can comprise an electromagnetic actuator. In this second embodiment, the drive element is in mechanical connection with the first displacement element. It is therefore possible to displace an attachment of the first balance spring which is secured on the first displacement element, relative to the frame. Thus, the attachment of the first balance spring is connected to the frame, and is displaceable relative to the frame. The said attachment of the first balance spring is also displaceable relative to the first balance. The said attachment is preferably disposed at an end, in particular an outer end, of the first balance spring. Alternatively, the frequency of the oscillator can be lower than the frequency of the oscillator, and the triggering element can comprise a frequency multiplier. Alternatively, the second oscillator can be replaced by a detector or a position sensor for cancellation of the speed of the balance. This sensor or detector is connected to the activation element of the first element of the first sub-system. Thus the first element M11 is activated at the instants, or substantially at the instants, when the speed of the first balance is zero.

In a third embodiment of the regulating system according to the invention, an attachment of the first balance spring is secured on a first displacement element which is connected to the first balance, and is displaceable or is not displaceable relative to the first balance. As is the case for the first embodiment, the displacements of the first displacement element can be one-way. Alternatively, its displacements can be two-way. In this case, the displacements can be symmetrical or they can be asymmetrical, i.e. their amplitude in one direction is different from their amplitude in the other direction. In particular, the displacement of the first displacement element is for example a rotation centered on the axis of rotation of the balance according to a first and/or a second direction of rotation. The angular arc traveled by the balance spring, in particular the attachment of the balance spring, which for example is disposed at one end of the balance spring, can differ according to the direction of rotation of the balance. The impulse can vary such as to give precedence to one or the other of the two directions of rotation of the attachment of the balance spring throughout a period of the oscillator, and thus permit the displacement of the attachment of the balance spring in a first or a second direction, in at least one period of the oscillator. The displacement, in particular the distance or the angle of displacement of the first element can vary, in particular from one impulse to another of the first activation element A11.

In a fourth embodiment of the regulating system according to the invention, an attachment of the second balance spring is secured on a second displacement element which is connected to the second balance, and is displaceable or is not displaceable relative to the second balance. As is the case for the first embodiment, the displacements of the second displacement element can vary.

In a first variant of the third embodiment, an attachment of the first balance spring is secured on a first displacement element which is secured on the first balance, for example on the felloe of the first balance. Thus, the attachment of the first balance spring is secured on the first balance. It is therefore possible to displace an attachment of the first balance spring which is secured on the first displacement element solely relative to the frame, by means of a first activation element, which activates the first displacement element by intermittence. The said attachment is preferably disposed at one end, in particular an inner end, of the first balance spring. In this variant, an impulse is imparted to the first balance.

In a first variant of the fourth embodiment, in a manner similar to that of the description previously given relative to the first sub-system, an attachment of the second balance spring is secured on a second displacement element which is secured on the second balance, for example on the felloe of the second balance. Thus, the attachment of the second balance spring is secured on the second balance. It is therefore possible to displace an attachment of the second balance spring which is secured on the second displacement element solely relative to the frame, by means of a second activation element, which activates the second displacement element by intermittence. The said attachment is preferably disposed at one end, in particular an inner end, of the second balance spring. In this variant, an impulse is imparted to the second balance.

In a second variant of the third embodiment, an attachment of the first balance spring is secured on a first displacement element which is connected to the first balance, and is displaceable relative to the first balance. In other words, the first displacement element is mounted on the first balance such that at least one movement or displacement of the first displacement element relative to the first balance is permitted. For example, the first displacement element could be implemented by means of a collet of the first balance which is mobile relative to the first balance. It is therefore possible to displace an attachment of the first balance spring, which attachment is secured on the first displacement element, relative to the first balance and to the frame, by means of a first activation element which activates the first displacement element by intermittence, for example by means of at least one kinematic chain comprising a differential gear or a planetary gear train.

In a second variant of the fourth embodiment, in a manner similar to that of the description previously given relating to the first sub-system, an attachment of the second balance spring is secured on a second displacement element which is connected to the second balance, and is displaceable relative to the second balance. In other words, the second displacement element is mounted on the second balance such that at least one movement or displacement of the second displacement element relative to the second balance is permitted. For example, the second displacement element could be implemented by means of a collet of the second balance which is mobile relative to the second balance. It is therefore possible to displace an attachment of the second balance spring, which attachment is secured on the second displacement element, relative to the second balance and to the frame, by means of a second activation element which activates the second displacement element by intermittence, for example by means of at least one kinematic chain comprising a differential gear or a planetary gear train.

In a fifth embodiment of the regulating system according to the invention, it is proposed to control only the first displacement element of the third embodiment, preferably by means of a second oscillator such as the one described in the second embodiment of the regulating system according to the invention.

In a sixth embodiment of the regulating system according to the invention, the first displacement element can displace the first balance spring relative to at least the first and second attachments which are connected respectively to the frame and to the first balance. In this case, the first displacement element acts by intermittence on the balance spring, in particular on one or a plurality of strips of the balance spring, or for example on one or a plurality of rigid parts which form the junction between the strips of the balance spring. In other words, the first displacement element is in interaction with the first balance spring only when the first displacement element supplies an impulse to the first balance spring. This interaction can take place by contact or not by contact, by supplying for example a mechanical impulse or a magnetic impulse, or also an electrostatic impulse.

In a seventh embodiment of the regulating system according to the invention, the second displacement element can displace the second balance spring relative to at least the first and second attachments which are connected respectively to the frame and to the second balance. In this case, the second displacement element acts by intermittence on the balance spring, in particular on one or a plurality of strips of the second balance spring. In other words, the second displacement element is in interaction with the second balance spring only when the second displacement element supplies an impulse to the second balance spring. This interaction can take place by contact or not by contact, by supplying for example a mechanical impulse or a magnetic impulse, or also an electrostatic impulse.

In an eighth alternative embodiment of the regulating system according to the invention, it is proposed to control only the first displacement element of the sixth embodiment, preferably by means of a second oscillator such as the one described in the second embodiment of the regulating system according to the invention.

In the different embodiments, the displacement elements can supply displacement impulses, in particular mechanical displacement impulses. In the eighth embodiment, the displacement impulses can for example be mechanical, magnetic, or electrostatic.

Preferably, in each of the embodiments, the attachment of the first balance spring which connects the first balance spring to the balance, by means of the first displacement element or not by means of this element, is situated at the inner end of the first balance spring, and the attachment of the first balance spring which connects the first balance spring to the frame, by means of the first displacement element or not by means of this element, is situated at the outer end of the first balance spring. Alternatively, the attachment of the first balance spring which connects the first balance spring to the balance, by means of the first displacement element or not by means of this element, can be situated at the outer end of the first balance spring, and the attachment of the first balance spring which connects the first balance spring to the frame, by means of the first displacement element or not by means of this element, can be situated at the inner end of the first balance spring. Similarly, in each of the embodiments, the attachment of the second balance spring which connects the second balance spring to the balance, by means of the second displacement element or not by means of this element, is preferably situated at the inner end of the second balance spring, and the attachment of the second balance spring which connects the second balance spring to the frame, by means of the second displacement element or not by means of this element, is preferably situated at the outer end of the second balance spring. Alternatively, the attachment of the second balance spring which connects the second balance spring to the balance, by means of the second displacement element or not by means of this element, can be situated at the outer end of the second balance spring, and the attachment of the second balance spring which connects the second balance spring to the frame, by means of the second displacement element or not by means of this element, can be situated at the inner end of the second balance spring.

In the first, third, fourth, sixth, and seventh embodiments, the first and second sub-systems preferably have a symmetrical structure and/or symmetrical behavior. The second sub-system is preferably identical or similar to the first sub-system. However, the second sub-system can differ from the first sub-system, with a first sub-system of a first variant of a preferred embodiment being able to cooperate with a second sub-system of a second variant of a preferred embodiment.

In the different embodiments, the regulating system preferably comprises two oscillators. It could however comprise more than two oscillators, in particular three oscillators, in particular four oscillators. Advantageously, at least a third oscillator, with substantially the same frequency as the first and second oscillators, or not with the same frequency, would make it possible to control and/or synchronize the phases of each of the first and second oscillators.

In the different embodiments and variants, the attachment can comprise one or a plurality of attachment points.

In the different embodiments and variants, the system can be designed such that the displacement, in particular the distance or the angle of displacement, of the first element M11; M111; M211, varies during functioning, and/or it can be designed such that the displacement, in particular the distance or the angle of displacement, of the second element M12; M112; M212, varies during functioning.

Except in cases of technical or logical incompatibility, the different embodiments and variants can be combined with one another.

Contrary to the above-described regulating systems, a structure such as that known from the documents according to the prior art WO0004424 and WO0004425 does not make it possible to act on the balance spring of an oscillator at the instant when the balance of this oscillator is at zero speed. Nor is any means for detection of the minimum or maximum amplitude of the balance spring disclosed.

The invention also relates to a functioning method of a system 10; 110; 210 for regulating a horology movement 2; 12; 22, the system comprising a first sub-system 11; 111; 211 which is coupled to a second sub-system 12; 112; 212, the first sub-system including:

- a first oscillator O11; O111; O211 including a first balance B11; B111; B211 and a first balance spring S11; S111; S211;
- a first element M11; M111; M211 for displacement of the first balance spring S11; S111; S211; and
- a first element A11; A111; A211 for activation of the first displacement element M11; M111; M211, the method comprising activation of the first displacement element which takes place at instants, or substantially at instants, when the speed of the first balance B11; B111; B211 is zero, i.e. at instants, or substantially at instants, when the balance is in a minimum or maximum angular position, the first displacement element displacing, when it is activated, an end or an attachment of the first balance spring under the effect of an impulse, or, when it is activated, the first displacement element applying to an end or an attachment of the first balance spring an impulse in order to modify its potential energy.

The invention claimed is:

1. A regulating system (10; 110; 210) for a horology movement (2; 12; 22) comprising a first sub-system (11; 111; 211) coupled to a second sub-system (12; 112; 212), the first sub-system including:

- a first oscillator (O11; O111; O211) which includes a first balance (B11; B111; B211) and a first balance spring (S11; S111; S211);
- a first element (M11; M111; M211) for displacement of the first balance spring (S11; S111; S211), which is designed to displace an end or an attachment of the first balance spring under the effect of an impulse; and
- a first element (A11; A111; A211) for activation of the first displacement element (M11; M111; M211), the activation taking place at an instant, or substantially at an instant, when the speed of the first balance (B11; B111; B211) is zero, i.e. at an instant, or substantially at an instant, when the first balance is in a minimum or maximum angular position.

2. The regulating system as claimed in claim 1, wherein the system comprises a frame (13; 113; 213), and wherein the first displacement element (M11; M111; M211) permits one-way displacement of the first balance spring (S11; S111;

S211) relative to the frame and/or to the first balance (B11; B111; B211; B11'), or the first displacement element permits two-way displacement of the first balance spring (S11; S111; S211) relative to the frame and/or to the first balance (B11; B111; B211).

3. The regulating system as claimed in claim 2, wherein the displacement is a displacement in rotation around the axis of rotation of the first balance (B11; B111; B211).

4. The regulating system as claimed in claim 1, wherein the system comprises a second oscillator (O12; O112; O212) associated with the first displacement element (M11; M111; M211) and/or with the first activation element (A11; A111; A211).

5. The regulating system as claimed in claim 4, wherein the natural oscillation frequency of the second oscillator (O12; O112; O212) is substantially equal to the natural oscillation frequency of the first oscillator (O11; O111; O211).

6. The regulating system as claimed in claim 5, wherein the oscillations of the second oscillator (O12; O112; O212) are offset by more or less a quarter of a period relative to the oscillations of the first oscillator (O11; O111; O211).

7. The regulating system as claimed in claim 4, wherein the second sub-system comprises:

the second oscillator (O12; O112; O212) which includes a second balance (B12; B112; B212) and a second balance spring (S12; S112; S212);

a second element (M12; M112; M212) for displacement of the second balance spring (S12; S112; S212) which is designed to displace an end or an attachment of the second balance spring under the effect of an impulse; and a second element (A12; A112; A212) for activation of the second displacement element, the activation taking place at an instant, or substantially at an instant, when the speed of the second balance (B11; B111; B211) is zero, i.e. at an instant, or substantially at an instant, when the second balance is in a minimum or maximum angular position.

8. The regulating system as claimed in claim 7, wherein the system comprises a frame (13; 113; 213), and wherein the second displacement element (M12; M112; M212) permits one-way displacement of the second balance spring (S12; S112; S212) relative to the frame and/or to the second balance (B12; B112; B212), or the second displacement element permits two-way displacement of the second balance spring (S12; S112; S212) relative to the frame and/or to the second balance (B12; B112; B212).

9. The regulating system as claimed in claim 1, wherein the first displacement element (M111; M211) comprises a first lever or a first wheel which is pivoted on the axis of the first balance (B111; B211).

10. The regulating system as claimed in claim 1, wherein the first activation element (A111; A211) of the first displacement element (M111; M211) comprises a first drive element (E111; E211) of the first displacement element, and a first triggering element (D111; D211) of the first drive element.

11. The regulating system as claimed in claim 10, wherein the first drive element (E111) comprises a first lever (L111) and a first cam (CA111), the first lever (L111) co-operating with the first cam (CA111) which is rotated by a drive organ.

12. The regulating system as claimed in claim 11, wherein the first lever (L111) comprises a first follower (L121) which is brought back into contact with the first cam by a first resilient element (R111) and/or a first element (GL111) which cooperates as an obstacle with the first displacement element.

13. The regulating system as claimed in claim 10, wherein the first triggering element (D111; D211) comprises a first blocking lever (BL111; BL211) of a first blocking wheel (RB111; RB211) which is integral with the cam (CA111; CA211).

14. The regulating system as claimed in claim 13, wherein the first blocking lever (BL111; BL211) comprises a first fork which cooperates with a pin provided on the second balance.

15. The regulating system as claimed in claim 13, wherein the system comprises a frame (13; 113; 213), and wherein the first blocking lever is pivoted on an axis which is fixed relative to the frame, or the first blocking lever is pivoted on an axis which is mobile relative to the frame.

16. The regulating system as claimed in claim 1, wherein the second sub-system is identical to the first sub-system, the second sub-system including:

a second oscillator which includes a second balance and a second balance spring;

a second element for displacement of the second balance spring, which is designed to displace an end or an attachment of the second balance spring under the effect of an impulse; and a second element for activation of the second displacement element, the activation taking place at an instant, or substantially at an instant, when the speed of the second balance is zero, i.e. at an instant, or substantially at an instant, when the second balance is in a minimum or maximum angular position, the first activation element being in interaction with the second oscillator, and the second activation element being in interaction with the first oscillator.

17. The regulating system as claimed in claim 16, wherein a first blocking lever is in interaction with a second balance of the second oscillator, and a second blocking lever is in interaction with the first balance of the first oscillator.

18. A horology movement (2; 12; 22) comprising a regulating system (10; 110; 210) as claimed in claim 17.

19. A horology piece (3; 13; 23) comprising a regulating system as claimed in claim 1.

20. A horology piece (3; 13; 23) comprising a horology movement as claimed in claim 18.

* * * * *